US005240300A

United States Patent [19]

Ramsey

[11] Patent Number: 5,240,300

[45] Date of Patent: Aug. 31, 1993

[54] DEVICE FOR HAND-CARRYING ARTICLES

[76] Inventor: Michael D. Ramsey, 3700-G Meriwether Dr., Durham, N.C. 27704

[21] Appl. No.: 914,517

[22] Filed: Jul. 17, 1992

[51] Int. Cl.[5] ..... B65D 63/18; B65D 69/00

[52] U.S. Cl. ..... 294/153; 294/164; 294/166

[58] Field of Search ..... 294/137, 141-143, 294/145, 147-151, 153-159, 162-166, 170, 171; 24/130; 224/103

[56] References Cited

U.S. PATENT DOCUMENTS

| | | | |
|---|---|---|---|
| 1,255,273 | 2/1918 | Anderson | 294/170 |
| 2,981,990 | 5/1961 | Balderree | 294/137 X |
| 3,137,421 | 6/1964 | Haddock | 294/153 X |
| 4,091,976 | 5/1978 | Morse | 294/153 X |
| 4,696,505 | 9/1987 | Shadoan | 294/153 |
| 4,730,863 | 3/1988 | Guadnola | 294/156 |
| 4,772,059 | 9/1988 | Parry et al. | 294/158 X |
| 4,832,393 | 5/1989 | Pitchford | 294/156 |
| 4,841,596 | 6/1989 | Fink | 294/170 X |
| 5,169,198 | 12/1992 | Volk et al. | 294/137 |

*Primary Examiner*—Johnny D. Cherry
*Attorney, Agent, or Firm*—Richard E. Jenkins

[57] ABSTRACT

A device for hand-carrying articles in cooperation with a string, strap, shoelace or the like includes a grip element for grasping of the device by a user. Support elements extend upwardly from opposed ends of the grip element, and arm elements are connected at proximal ends thereof to the support elements. Each of the arm elements defines a distal end, and the arm elements extend inwardly toward each other from the support elements with the distal ends positioned in closely spaced apart relationship with each other to form a gap therebetween. The arm elements are configured for enabling movement of the arm elements relative to each other to vary the size of the gap, and gripping elements are provided on the distal ends of the arm elements for enabling a string, strap, shoelace or the like to be tightly gripped and held in position in the gap between the arm elements.

14 Claims, 2 Drawing Sheets

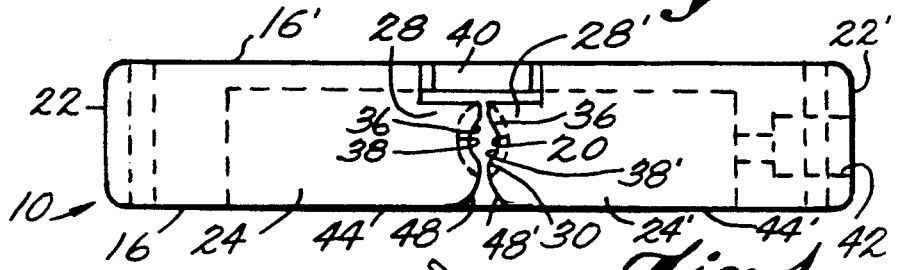
Fig. 3.
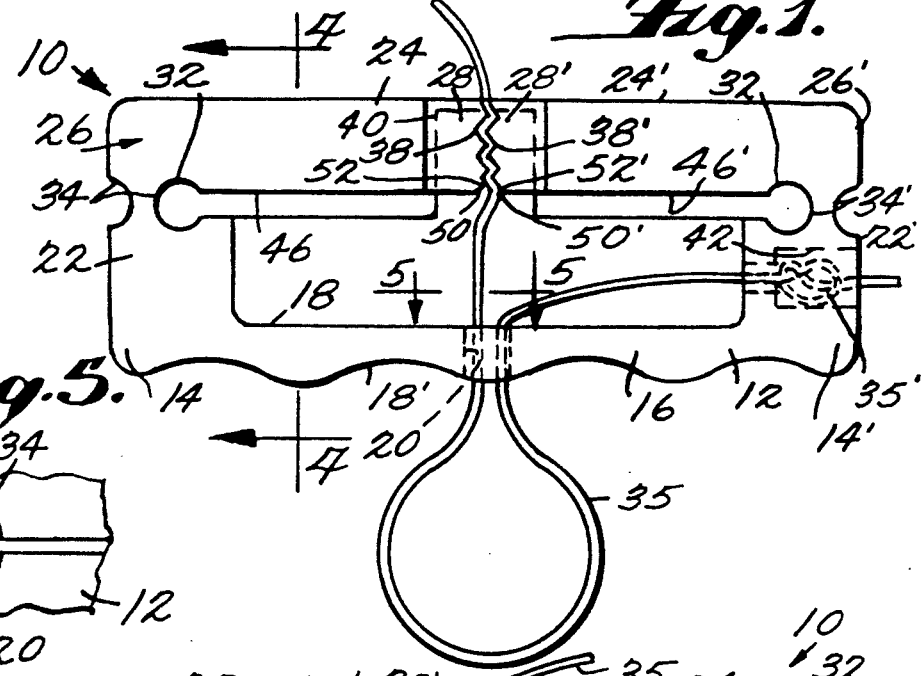
Fig. 1.
Fig. 5.
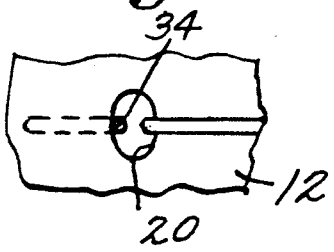
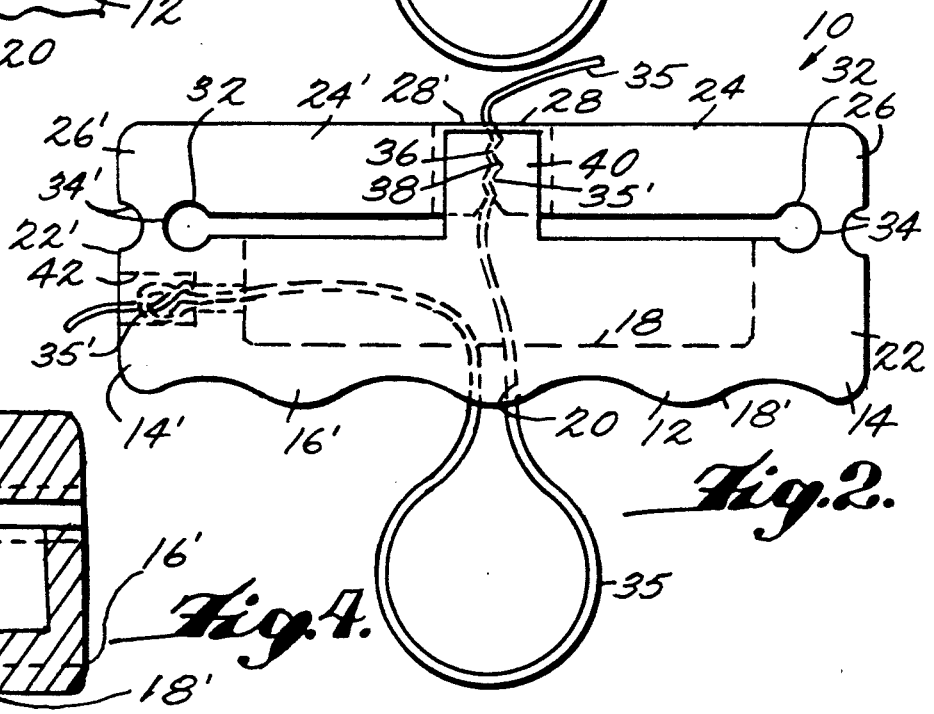
Fig. 2.
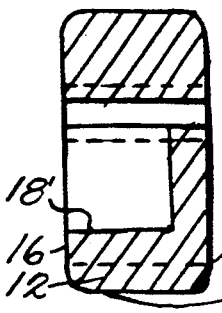
Fig. 4.

Fig. 8.
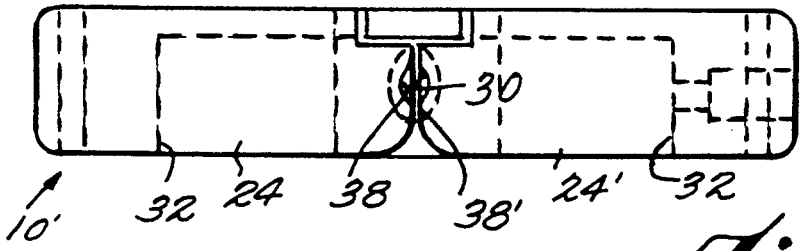
Fig. 6.
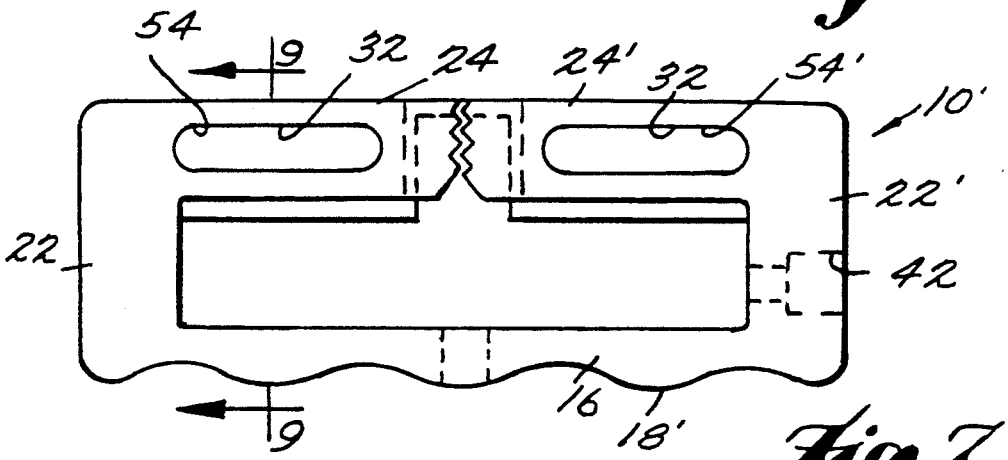
Fig. 7.
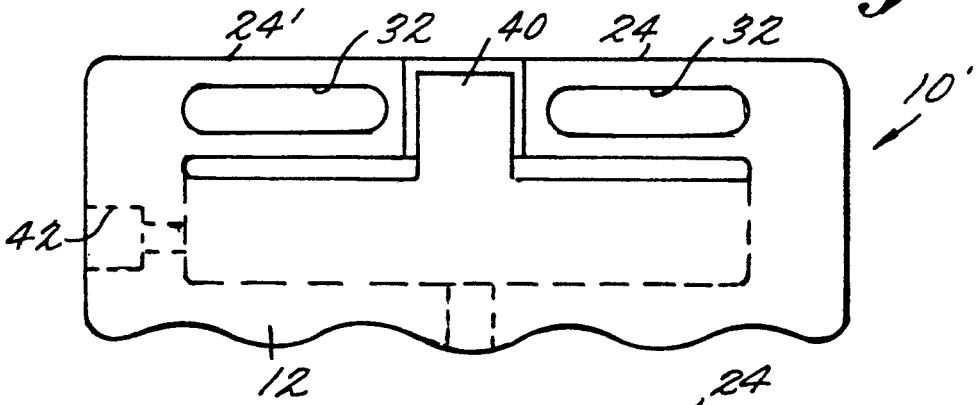
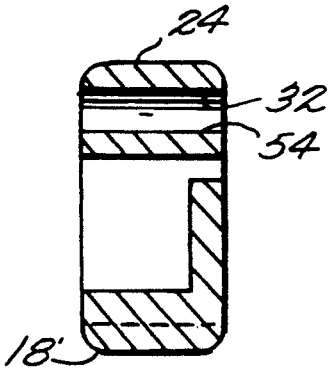
Fig. 9.

DEVICE FOR HAND-CARRYING ARTICLES

This invention relates to article-carrying devices and more particularly to a device for hand-carrying articles in cooperation with a string, strap, shoelace or the like.

Hand-carrying of shoes, boots, skates, roller blades and other items of footwear is often awkward and inconvenient because the footwear items are not conveniently grasped and held together. The separate items of footwear must be awkwardly grasped and carried by one hand of the user, or both hands may be required. Frequently, the laces of the shoe, boot or skate will be tied together so that both items of footwear can be more conveniently carried by one hand, but the laces must then be untied before the footwear can be worn.

It is, therefore, an object of the present invention to provide a device for conveniently carrying articles.

Another object is to provide such a device that is particularly adapted for hand-carrying shoes, boots or skates having laces associated therewith.

A further object of the invention is the provision of such a device which is small and compact for easy transport and storage when not in use.

Still another object is to provide such a device which enables articles to be easily and conveniently carried with one hand.

A still further object is to provide such a device which is easy and inexpensive to manufacture.

Yet another object of the present invention is the provision of such a device which is tough and durable.

Another object is to provide such a device which can be used for hand-carrying articles not normally associated with laces but which can be carried by use of a lace, string, strap or the like.

Still another object is to provide such a device for simultaneously hand-carrying a plurality of articles with one hand.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a device for hand-carrying articles, the device comprising: a grip element for grasping of the device by a user, the grip element defining first and second opposed ends, opposed front and rear surfaces, opposed upper and lower surfaces, and a first opening extending through the grip element between the upper and lower surfaces; first and second support elements extending upwardly from the first and second opposed ends, respectively; first and second arm elements connected at proximal ends thereof to the first and second support elements, respectively, each of the arm elements defining a distal end and the arm elements extending inwardly toward each other from the support elements with the distal ends positioned in closely spaced apart relationship with each other to form a gap therebetween; means in operative relationship with the arm elements for enabling movement of the arm elements relative to each other to vary the size of the gap; and gripping means in operative relationship with the distal ends of the arm elements for enabling a string, strap, lace or the like to be tightly gripped and held in position in the gap between the arm elements.

The device preferably includes a stop element which extends upwardly from the rear surface of the grip element and which is positioned adjacent to and behind the gap for preventing the string, strap, lace or the like from sliding out of the back of the gap.

It is to be understood that both the foregoing general description and the following detailed description are exemplary and explanatory but are not restrictive of the invention.

The accompanying drawings, which are incorporated in and constitute a part of this specification, illustrate examples of preferred embodiments of the invention and, together with the description, serve to explain the principles of the invention.

FIG. 1 is a front elevation view showing one preferred embodiment of the device and illustrating a lace held by the device;

FIG. 2 is a rear elevation view of the device shown in FIG. 1 and showing a lace held by the device;

FIG. 3 is a top plan view of the device shown in FIG. 1;

FIG. 4 is a cross-sectional view taken along the line 4—4 in FIG. 1 and looking in the direction of the arrows;

FIG. 5 is a fragmentary view taken along the line 5—5 in FIG. 1 and looking in the direction of the arrows;

FIG. 6 is a front elevation view of another preferred embodiment of the device;

FIG. 7 is a rear elevation view of the device shown in FIG. 6;

FIG. 8 is a top plan view of the device shown in FIG. 6; and

FIG. 9 is a cross-section view of the device shown in FIG. 6 taken along the line 9—9 thereof and looking in the direction of the arrows.

With reference now to the drawings, wherein like reference characters designate like or corresponding parts throughout the several views, there is shown in FIGS. 1-5 a device 10 for hand-carrying articles. Device 10 is comprised of a grip element 12 for grasping of device 10 by a user. Grip element 12 defines first and second opposed ends 14, 14', opposed front and rear surfaces 16, 16', opposed upper and lower surfaces 18, 18', and a first opening 20 extending through grip element 12 between upper surface 18 and lower surface 18'. First and second support elements 22, 22' extend upwardly from opposed ends 14, 14', respectively. First and second arm elements 24, 24' are connected at proximal ends 26, 26', respectively, to support elements 22, 22'. Each of arm elements 24, 24' defines a distal end 28, 28', respectively, and arm elements 24, 24' extend inwardly toward each other from support elements 22, 22' with distal ends 28, 28' positioned in closely spaced apart relationship with each other to form a gap 30 therebetween.

In accordance with the invention, means 32 are provided in operative relationship with arm elements 24, 24' for enabling movement of the arm elements relative to each other to vary the size of gap 30. As shown in FIGS. 1-3, movement enabling means 32 comprise hinge-like narrowed sections 34, 34' of support elements 22, 22', respectively, adjacent to proximal ends 26, 26', respectively, of arm elements 24, 24'. Hinge-like narrowed sections 34, 34' enable movement of arm elements 24, 24' with respect to support elements 22, 22' and with respect to each other by flexing of narrowed sections 34, 34' when force is applied to distal ends 28, 28' by weight on string, strap, shoelace or the like 35 held between arm elements 24, 24' in gap 30 by gripping means 36.

Gripping means 36 are provided in operative relationship with distal ends 28, 28' of arm elements 24, 24' for enabling string, strap, shoelace or the like 35 to be tightly gripped and held in position within gap 30 between arm elements 24, 24'. Gripping means 36 preferably comprises serrations 38, 38' on distal ends 28, 28', respectively.

The preferred embodiments of the invention illustrated in FIGS. 1-3 and in FIGS. 6-8 also include a stop element 40 extending upwardly from rear surface 16' of grip element 12 and positioned adjacent to and behind gap 30 for preventing string, strap, shoelace or the like 35 from sliding out of the back of gap 30. Each of distal ends 28, 28' preferably defines a concave surface, and serrations 38, 38' are also configured in a concave manner. This is best illustrated in FIGS. 3 and 8.

Support element 22' preferably defines a second opening 42 therein (FIGS. 1-3 and 6-8) for receiving string, strap, shoelace or the like 35, and opening 42 is preferably a counter-bored opening for facilitating receiving and retaining a knotted end 35' of string, strap, shoelace or the like 35.

Each of arm elements 24, 24' defines a forward surface 44, 44', respectively, and an arm element lower surface 46, 46', respectively. Each of arm elements 24, 24' further includes a first bevelled surface 48, 48', respectively, extending between forward surface 44, 44', respectively, and distal ends 28, 28', respectively. Each of arm elements 24, 24' further defines a second bevelled surface 50, 50', respectively, extending between lower surfaces 46, 46', respectively, and distal ends 28, 28', respectively. Bevelled surfaces 48, 48', 50 and 50' facilitate insertion into and removal from gap 30 of string, strap, shoelace or the like 35.

Each of arm elements 24, 24' further includes a third bevelled surfaces 48, 48' and bevelled surfaces 50, 50', respectively. Rounded surfaces 52, 52' are convex and further facilitate insertion into and removal from gap 30 of string, strap, shoelace or the like 35. Bevelled surfaces 48, 48', 50 and 50' also are preferably rounded in a convex manner.

Lower surface 18' of grip element 12 preferably defines an undulating surface for accommodating gripping by a user's hand. Device 10 is preferably monolithic in its construction to provide toughness and durability, and device 10 is preferably made of durable plastic material. Device 10 can be used to carry articles with laces, such as shoes, boots, skates or the like, and device 10 can also be used to carry articles which do not have laces by using a lace, string or strap.

When using device 10 to carry articles having laces, such as boots, shoes, skates or the like, an end of the lace in a first boot, for example, is removed from the top inside eyelet (not shown) of the boot. The lace exiting the matching eyelet in the other boot is then placed through the vacant eyelet from the outside in. As the single lace is lifted, both boots will lift and neatly pair together. The lace is then inserted upwardly through opening 20 in grip element 12. It is then pulled upwardly and into position between distal ends 28, 28' of arm elements 24, 24'. Serrations or gripping teeth 38, 38' grip the lace and hold the lace in position between distal ends 28, 28'. Device 10 can be positioned at any convenient location along the length of the lace, and device 10 can then be used for carrying the boots (not shown) by grasping undulating lower surface 18'. Device 10 can also be used for hanging or suspending the boots (not shown) from a hook or other support. The lace is quickly and easily removed from device 10 by first reducing tension on the lace and by then withdrawing the lace from gap 30.

When device 10 is carried with boots, shoes, skates or the like (not shown) suspended from device 10 by a lace, string or strap, the weight of the footwear on the lace causes distal ends 28, 28' of arm elements 24, 24' to be pulled downwardly as a result of the gripping action by serrations 38, 38' on the lace. This downward movement of distal ends 28, 28' is facilitated by the hinging action of hinge-like narrowed sections 34, 34', and gap 30 is narrowed to tighten the grip of serrations 38, 38' on the lace. As a result, the weight of the boots, skates, shoes or the like causes a tight grip on the lace by serrations 38, 38'.

When it is desired to remove the boots, shoes, skates or the like from device 10, tension on the lace is reduced, for example, by placing the boots, shoes, skates or the like on a supporting surface (not shown). The lace can then be easily removed from gap 30 by pulling the upper end of the lace forwardly with respect to device 10.

Device 10 can also be used for carrying articles that do not have laces. This is shown in FIGS. 1 and 2. One end of lace, string or strap 35 is passed through opening 42 and a knot 35' is formed at that end of the lace, string or strap. Knot 35' will be held firmly in position within opening 42 because of the counter-sunk configuration of opening 42. A second end of lace 35 is then fed downwardly through opening 20, and is passed through the article or articles to be carried (not shown). The free end of lace 35 is then passed back upwardly through opening 20 and is secured between distal ends 28, 28' by serrations or gripping teeth 38, 38', as previously described. The weight of the articles being carried on lace 35 will cause distal ends 28, 28' to rotate downwardly as a result of the hinging action of hinge-like narrowed sections 34, 34' so that serrations or gripping teeth 38, 38' will tightly grip lace 35. Here again, the weight of the articles being carried (not shown) will cause a tight grip on lace 35 by serrations or gripping teeth 38, 38'.

When it is desired to remove the articles being carried from device 10, tension on lace 35 is reduced or eliminated, for example, by placing the articles on a supporting surface (not shown). Lace 35 can then be quickly and easily withdrawn by pulling lace 35 forwardly with respect to gap 30. Lace 35 can then be removed from the articles being carried, and the lace can be completely removed from device 10 by pulling the lace outwardly through opening 42 or by undoing knot 35' and then removing the lace from device 10.

Another preferred embodiment of the invention is illustrated in FIGS. 6-9. This embodiment is identical with respect to the embodiment shown in FIGS. 1-5 with the exception that movement enabling means 32 comprises elongated openings 54, 54' defined within arm elements 24, 24'. Openings respect to each other when force is applied to distal ends 28, 8' by weight on a string, strap, shoelace or the like, as previously described with respect to the embodiment shown in FIGS. 1-5. The hollowed configuration of arm members 24, 24' created by openings 54, 54' provides the necessary degree of flexibility for arm elements 24, 24'.

Use and operation of device 10', illustrated in FIGS. 6–9 is the same as that previously described with respect to device 10.

This invention provides devices 10, 10' for hand-carrying articles in a convenient manner. The invention in its broader aspects is not limited to the specific details shown and described, and departures may be made from such details without departing from the principles of the invention and without sacrificing its chief advantages.

What is claimed is:

1. A device for hand-carrying articles, said device comprising:

a grip element for grasping of said device by a user, said grip element defining first and second opposed ends, opposed front and rear surfaces, opposed upper and lower surfaces, and a first opening extending through said grip element between said upper and lower surfaces;

first and second support elements extending upwardly from said first and second opposed ends, respectively;

first and second arm elements connected at proximal ends thereof to said first and second support elements, respectively, each of said arm elements defining a distal end and said arm elements extending inwardly toward each other from said support elements with said distal ends positioned in closely spaced apart relationship with each other to form a gap therebetween;

means in operative relationship with said arm elements for enabling movement of said arm elements relative to each other to vary the size of said gap; and gripping means in operative relationship with said distal ends of said arm elements for enabling a string, strap, shoelace or the like to be tightly gripped and held in position in said gap between said arm elements.

2. A device as in claim 1 further including a stop element extending upwardly from said rear surface and positioned adjacent to and behind said gap for preventing said string, strap, shoelace or the like from sliding out of the back of said gap.

3. A device as in claim 2 wherein each of said distal ends defines a concave surface.

4. A device as in claim 3 wherein said gripping means include serrations on said distal ends.

5. A device as in claim 2 wherein said second support element defines a second opening therein for receiving said string, strap, shoelace or the like.

6. A device as in claim 5 wherein said second opening is a counter-bored opening for receiving and retaining a knotted end of said string, strap, shoelace or the like.

7. A device as in claim 2 wherein said lower surface of said grip element defines an undulating surface for accommodating gripping by a user's hand.

8. A device as in claim 2 wherein each of said arm elements defines a forward surface and an arm element lower surface, each of said arm elements further including:

a first bevelled surface extending between said forward surface and said distal end; and a second bevelled surface extending between said arm element lower surface and said distal end for facilitating insertion into and removal from said gap of said string, strap, shoelace or the like.

9. A device as in claim 8 wherein each of said arm elements further includes a third rounded surface extending between said first bevelled surface and said second bevelled surface.

10. A device as in claim 9 wherein said first bevelled surface and said second bevelled surface are rounded in a convex manner.

11. A device as in claim 2 wherein said movement enabling means comprise a hinge-like narrowed section of said support elements adjacent to said proximal ends of said arm elements for enabling movement of said arm elements with respect to said support elements and with respect to each other by flexing of said narrowed sections when force is applied to said distal ends by weight on said string, strap, shoelace or the like held in said gap between said arm elements by said gripping means.

12. A device as in claim 2 wherein said movement enabling means comprise elongated openings defined within each of said arm elements for enabling flexible movement of said arm elements with respect to each other when force is applied to said distal ends by weight on said string, strap, shoelace or the like held in said gap between said arm elements by said gripping means.

13. A device as in claim 2 which is monolithic in its construction.

14. A device as in claim 13 which is made of plastic.

* * * * *